US008978770B2

(12) United States Patent
DeBerry et al.

(10) Patent No.: US 8,978,770 B2
(45) Date of Patent: Mar. 17, 2015

(54) SYSTEMS AND METHODS FOR RISER COUPLING

(71) Applicant: Dril-Quip, Inc., Houston, TX (US)

(72) Inventors: Blake T. DeBerry, Houston, TX (US); Morris B. Wade, Tomball, TX (US); James Daryl Kizer, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 13/892,823

(22) Filed: May 13, 2013

(65) Prior Publication Data

US 2013/0299178 A1 Nov. 14, 2013

Related U.S. Application Data

(60) Provisional application No. 61/646,847, filed on May 14, 2012.

(51) Int. Cl.

| | |
|---|---|
| ***E21B 17/02*** | (2006.01) |
| ***E21B 17/08*** | (2006.01) |
| ***E21B 19/16*** | (2006.01) |
| ***E21B 19/06*** | (2006.01) |

(52) U.S. Cl.

CPC ..... *E21B 17/085* (2013.01); *E21B 19/16* (2013.01); *E21B 19/06* (2013.01)

USPC ..... 166/344; 166/360; 166/367

(58) Field of Classification Search

CPC ..... E21B 17/085

USPC ..... 166/344, 360, 367, 379, 77.51, 85.1; 285/922; 405/169, 170

See application file for complete search history.

(56) References Cited

U.S. PATENT DOCUMENTS

| | | | | |
|---|---|---|---|---|
| 4,491,346 | A * | 1/1985 | Walker | 285/18 |
| 4,496,172 | A * | 1/1985 | Walker | 285/18 |
| 4,557,508 | A * | 12/1985 | Walker | 285/84 |
| 5,421,623 | A * | 6/1995 | Cassin | 285/343 |
| 5,441,311 | A * | 8/1995 | Watkins | 285/18 |
| 5,634,671 | A * | 6/1997 | Watkins | 285/18 |
| 5,992,893 | A | 11/1999 | Watkins | |
| 7,331,395 | B2 * | 2/2008 | Fraser et al. | 166/345 |
| 7,337,848 | B2 * | 3/2008 | Fraser et al. | 166/345 |
| 7,503,391 | B2 * | 3/2009 | McCanna et al. | 166/343 |
| 7,686,087 | B2 * | 3/2010 | Pallini et al. | 166/367 |
| 7,686,342 | B2 * | 3/2010 | Jennings et al. | 285/39 |

(Continued)

OTHER PUBLICATIONS

Singapore Examination Report and Written Opinion issued in related Singapore Patent Application No. 213036603 mailed Jul. 9, 2014, 7 pages.

*Primary Examiner* — Matthew Buck

(74) *Attorney, Agent, or Firm* — Baker Botts L.L.P.

(57) ABSTRACT

Systems and methods for riser coupling are disclosed. A riser coupling system comprises a riser joint connector comprising a first tubular assembly coupled to a second tubular assembly. The riser coupling system further comprises a spider assembly which receives the riser joint connector and has a connector actuation tool. The connector actuation tool comprises a dog assembly, a clamping tool and a splined member. The dog assembly selectively extends a dog to engage the riser joint connector. The clamping tool couples the first tubular assembly and the second tubular assembly. Finally, the splined member actuates a locking member of the riser joint connector.

18 Claims, 13 Drawing Sheets

(56) References Cited

U.S. PATENT DOCUMENTS

| | | | | |
|---|---|---|---|---|
| 7,913,767 | B2 * | 3/2011 | Larson et al. | 166/380 |
| 7,963,336 | B2 * | 6/2011 | Fraser et al. | 166/345 |
| 7,975,768 | B2 * | 7/2011 | Fraser et al. | 166/345 |
| 8,312,933 | B2 * | 11/2012 | Larson et al. | 166/380 |
| 8,317,234 | B2 * | 11/2012 | McKay | 285/81 |
| 8,356,672 | B2 * | 1/2013 | Fraser et al. | 166/345 |
| 2007/0044973 | A1 | 3/2007 | Fraser et al. | |
| 2009/0308658 | A1 | 12/2009 | Larson et al. | |

* cited by examiner

SYSTEMS AND METHODS FOR RISER COUPLING

CROSS-REFERENCE TO RELATED APPLICATION

The present applications claims the benefit of provisional application Ser. No. 61/646,847 which was filed on May 14, 2012.

BACKGROUND

The present disclosure relates generally to well risers and, more particularly, to systems and methods for riser coupling.

In drilling or production of an offshore well, a riser may extend between a vessel or platform and the wellhead. The riser may be as long as several thousand feet, and may be made up of successive riser sections. Riser sections with adjacent ends may be connected on board the vessel or platform, as the riser is lowered into position. Auxiliary lines, such as choke, kill, and/or boost lines, may extend along the side of the riser to connect with the wellhead, so that fluids may be circulated downwardly into the wellhead for various purposes. Connecting riser sections in end-to-end relation includes aligning axially and angularly two riser sections, including auxiliary lines, lowering a tubular member of an upper riser section onto a tubular member of a lower riser section, and locking the two tubular members to one another to hold them in end-to-end relation.

The riser section connecting process may require significant operator involvement that may expose the operator to risks of injury and fatigue. For example, the repetitive nature of the process over time may create a risk of repetitive motion injuries and increasing potential for human error. Moreover, the riser section connecting process may involve heavy components and may be time-intensive. Therefore, there is a need in the art to improve the riser section connecting process and address these issues.

BRIEF DESCRIPTION OF THE DRAWINGS

Some specific exemplary embodiments of the disclosure may be understood by referring, in part, to the following description and the accompanying drawings.

Figure 1A:
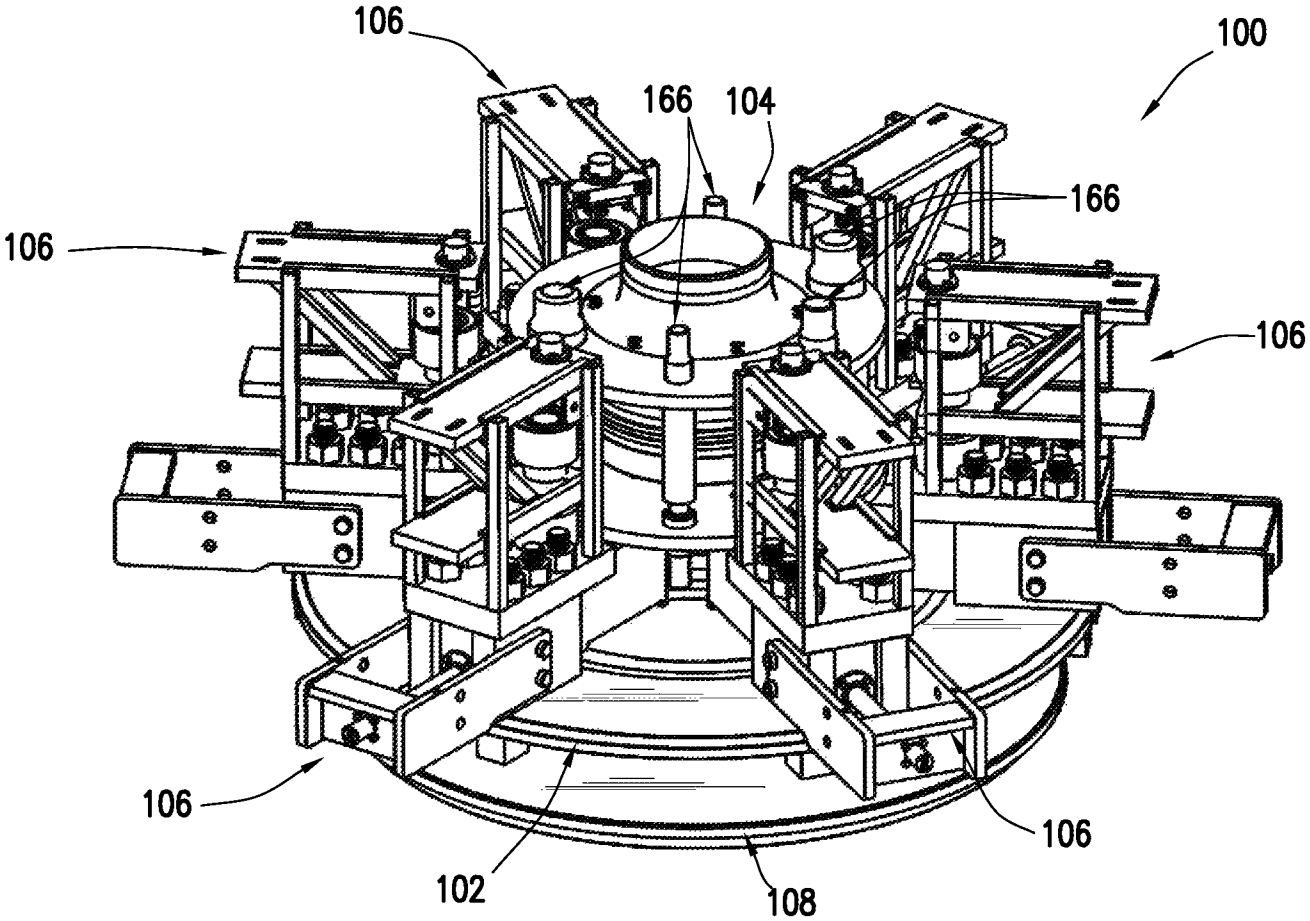
FIG. 1A shows an angular view of one exemplary riser coupling system, in accordance with certain embodiments of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well risers and, more particularly, to systems and methods for riser coupling.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves; and/or any combination of the foregoing.

For the purposes of this disclosure, a sensor may include any suitable type of sensor, including but not limited to optical, radio frequency, acoustical, pressure, torque, or proximity sensors.

Figure 1B:
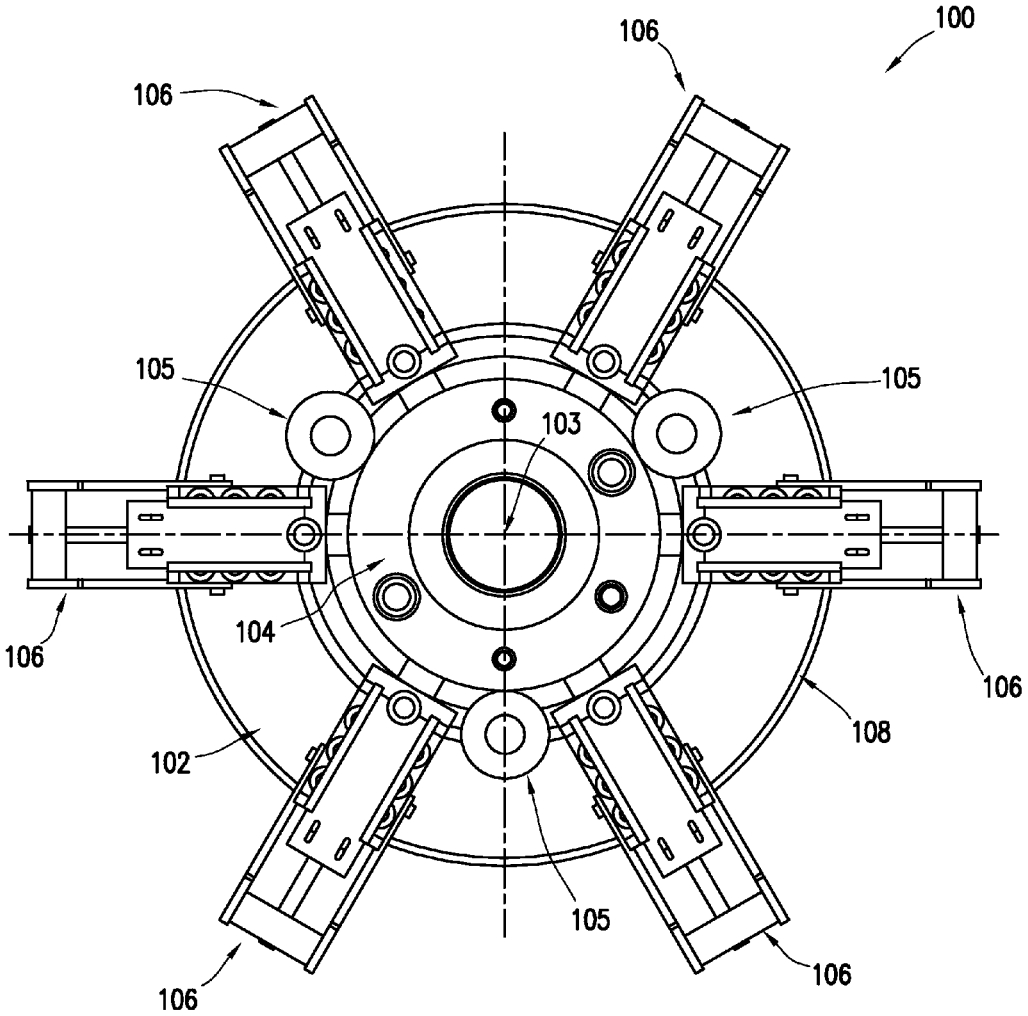
FIG. 1B shows a top view of a riser coupling system, in accordance with certain embodiments of the present disclosure.

FIG. 1A shows an angular view of one exemplary riser coupling system 100, in accordance with certain embodiments of the present disclosure. FIG. 1B shows a top view of the riser coupling system 100. The riser coupling system 100 may include a spider assembly 102 adapted to one or more of receive, at least partially orient, engage, hold, and actuate a riser joint connector 104. The spider assembly 102 may include one or more connector actuation tools 106. In certain embodiments, a plurality of connector actuation tools 106 may be spaced radially about an axis 103 of the spider assembly 102. By way of nonlimiting example, two connector actuation tools 106 may be disposed around a circumference of the spider assembly 102 in an opposing placement. The nonlimiting example of FIG. 1 show three pairs of opposing connector actuation tools 106. It should be understood that various embodiments may include any suitable number of connector actuation tools 106.

As depicted in FIG. 1B, certain embodiments may include one or more orienting members 105 disposed radially about the axis 103 to facilitate orientation of the riser joint connector 104. By way of example without limitation, three orienting members 105 may include a cylindrical or generally cylindrical form extending upwards from a surface of the spider assembly 102. The orienting members 105 may act as guides to interface the riser joint connector 104 as the riser joint connector 104 is lowered toward the spider assembly 102, thereby facilitating orientation and/or alignment. In certain embodiments, the orienting members 105 may be fitted with one or more sensors (not shown) to detect position and/or orientation of the riser joint connector 104, and corresponding signals may be transferred to an information handling system at any suitable location on a vessel or platform by any suitable means, including wired or wireless means.

The spider assembly 102 may include a base 108. The base 108, and the spider assembly 102 generally, may be mounted directly or indirectly on a surface of a vessel or platform. For example, the base 108 may be disposed on or proximate to a rig floor. In certain embodiments, the base 108 may include or be coupled to a gimbal mount to facilitate balancing in spite of sea sway.

Figure 2:
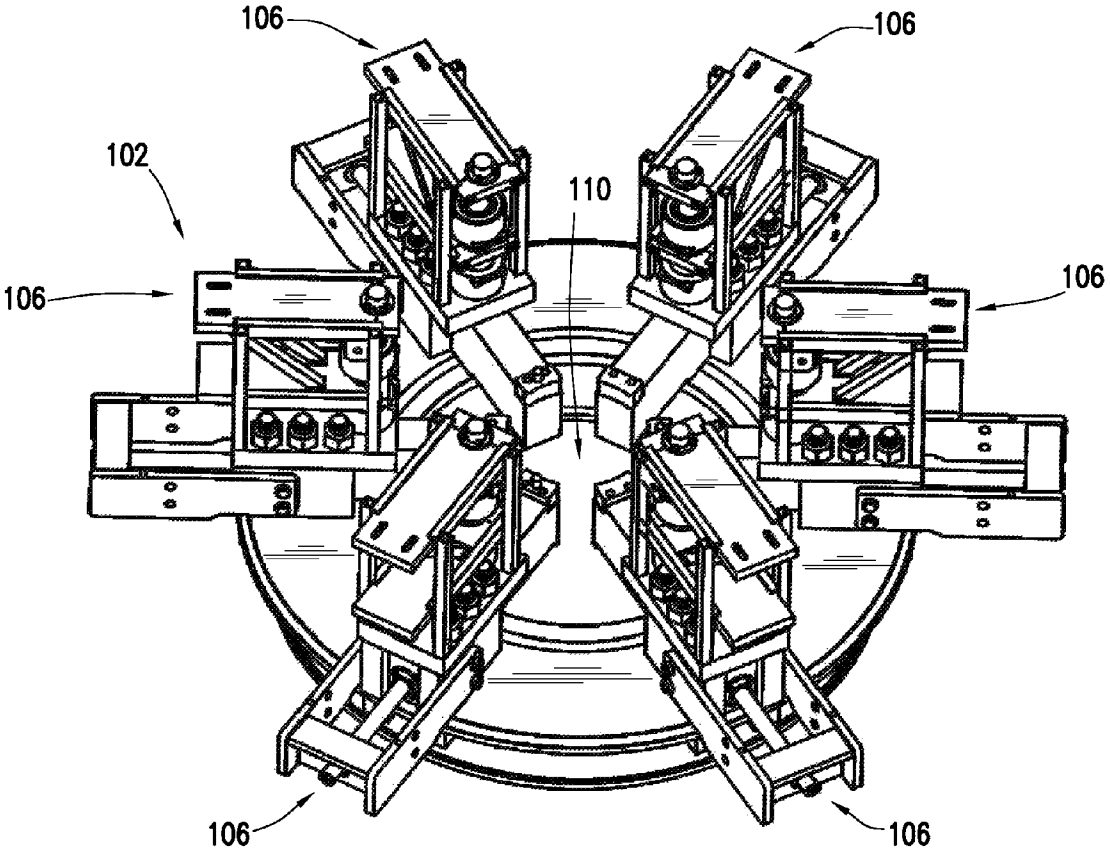
FIG. 2 shows an angular view of a spider assembly prior to receiving a connector assembly, in accordance with certain embodiments of the present disclosure.

FIG. 2 shows an angular view of the spider assembly 102 prior to receiving the riser joint connector 104 (depicted in FIGS. 1A and 1B). The nonlimiting example of the spider assembly 102 with the base 108 includes a generally circular geometry about a central opening 110 configured for running riser sections therethrough. Various alternative embodiments may include any suitable geometry.

Figure 3A:
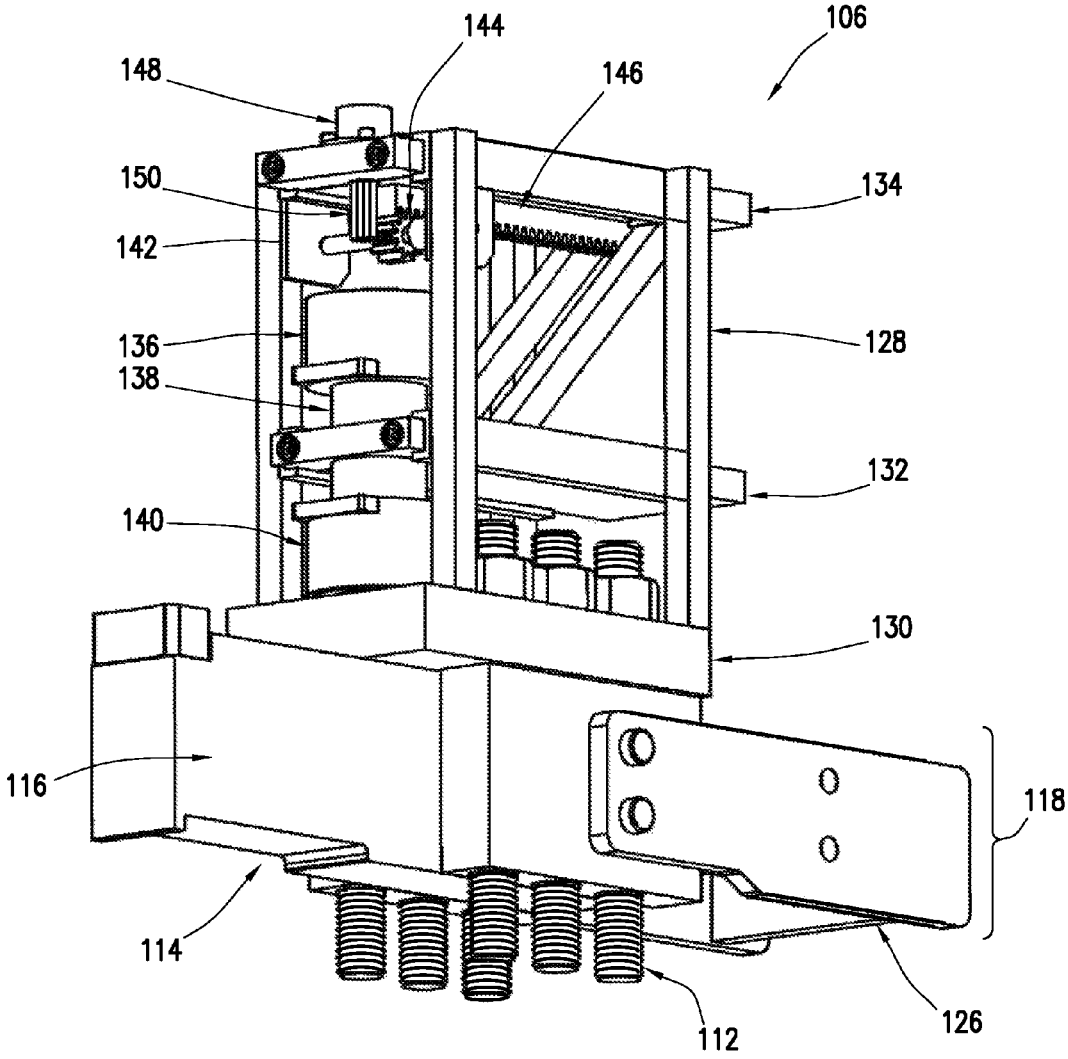
FIG. 3A shows an angular view of one exemplary connector actuation tool, in accordance with certain embodiments of the present disclosure.
Figure 3B:
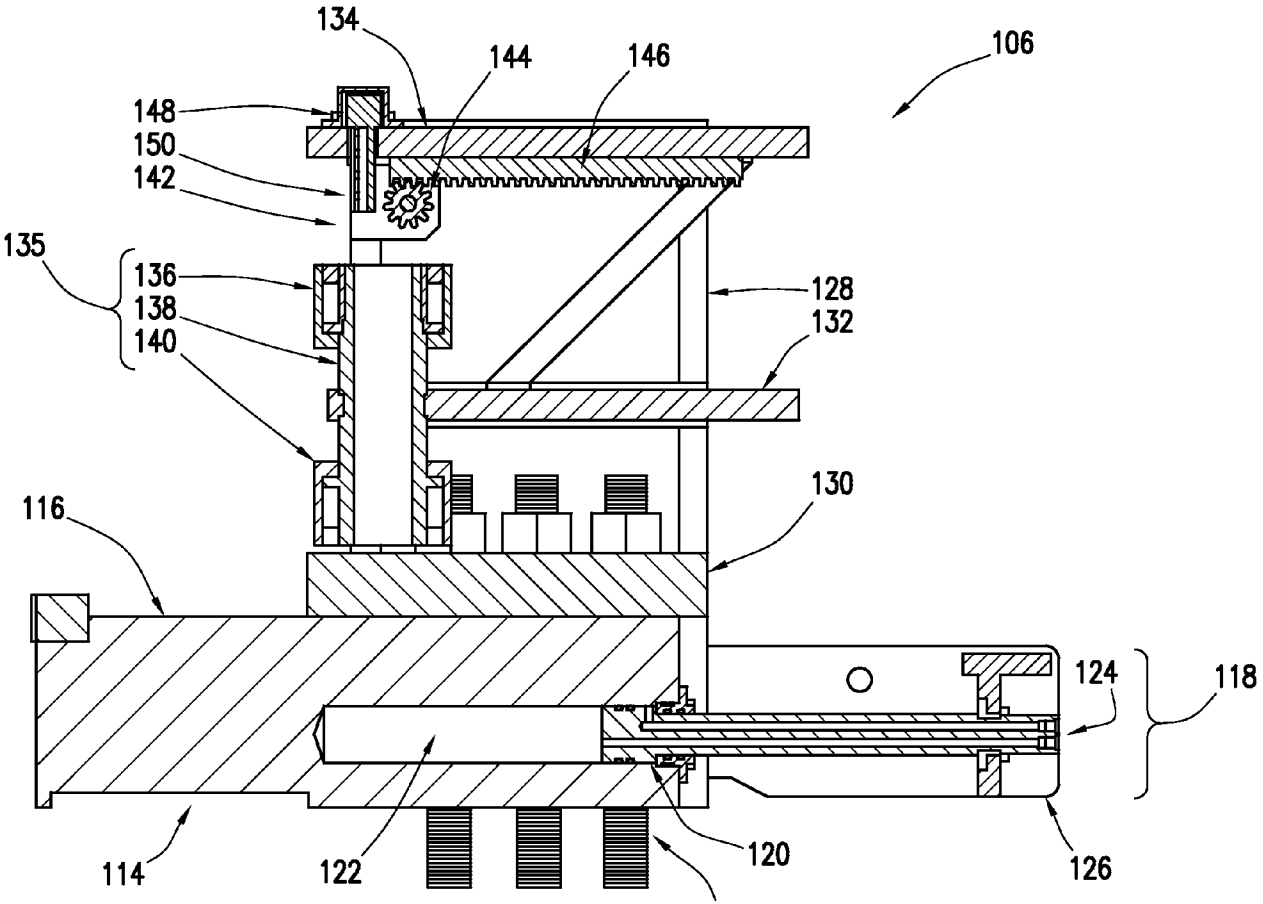
FIG. 3B shows a cross-sectional view of a connector actuation tool, in accordance with certain embodiments of the present disclosure.

FIG. 3A shows an angular view of one exemplary connector actuation tool 106, in accordance with certain embodiments of the present disclosure. FIG. 3B shows a cross-sectional view of the connector actuation tool 106. The connector actuation tool 106 may include a connection means 112 to allow connection to the base 108 (omitted in FIGS. 3A, 3B). As depicted, the connection means 112 may include a number of threaded bolts. However, it should be appreciated that any suitable means of coupling, directly or indirectly, the connector actuation tool 106 to the rest of the spider assembly 102 (omitted in FIGS. 3A, 3B) may be employed.

The connector actuation tool 106 may include a dog assembly 114. The dog assembly 114 may include a dog 116 and a piston assembly 118 configured to move the dog 116. The piston assembly 118 may include a piston 120, a piston cavity 122, one or more hydraulic lines 124 to be fluidically coupled to a hydraulic power supply (not shown), and a bracket 126. The bracket 126 may be coupled to a support frame 128 and the piston 120 so that the piston 120 remains stationary relative to the support frame 128. The support frame 128 may include or be coupled to one or more support plates. By way of example without limitation, the support frame 128 may include or be coupled to support plates 130, 132, and 134. The support plate 130 may provide support to the dog 116.

With suitable hydraulic pressure applied to the piston assembly 118 from the hydraulic power supply (not shown), the piston cavity 122 may be pressurized to move the dog 116 with respect to one or more of the piston 120, the bracket 126, the support frame 128, and the support plate 130. In the non-limiting example depicted, each of the piston 120, the bracket 126, the support frame 128, and the support plate 130 is adapted to remain stationary though the dog 116 moves. FIGS. 3A and 3B depict the dog 116 in an extended state relative to the rest of the connector actuation tool 106.

The connector actuation tool 106 may include a clamping tool 135. By way of example without limitation, the clamping tool 135 may include one or more of an upper actuation piston 136, an actuation piston mandrel 138, and a lower actuation piston 140. Each of the upper actuation piston 136 and the lower actuation piston 140 may be fluidically coupled to a hydraulic power supply (not shown) and may be moveably coupled to the actuation piston mandrel 138. With suitable hydraulic pressure applied to the upper and lower actuation pistons 136, 140, the upper and lower actuation pistons 136, 140 may move longitudinally along the actuation piston mandrel 138 toward a middle portion of the actuation piston mandrel 138. FIGS. 3A and 3B depict the upper and lower actuation pistons 136, 140 in a non-actuated state.

The actuation piston mandrel 138 may be extendable and retractable with respect to the support frame 128. A motor 142 may be drivingly coupled to the actuation piston mandrel 138 to selectively extend and retract the actuation piston mandrel 138. By way of example without limitation, the motor 142 may be drivingly coupled to a slide gear 144 and a slide gear rack 146, which may in turn be coupled to the support plate 134, the support plate 132, and the actuation piston mandrel 138. The support plates 132, 134 may be moveably coupled to the support frame 128 to extend or retract together with the actuation piston mandrel 138, while the support frame 128 remains stationary. FIGS. 3A and 3B depict the slide gear rack 146, the support plates 132, 134, and the actuation piston mandrel 138 in a retracted state relative to the rest of the connector actuation tool 106.

The connector actuation tool 106 may include a motor 148, which may be a torque motor, mounted with the support plate 134 and driving coupled to a splined member 150. The splined member 150 may also be mounted to extend and retract with the support plate 134. It should be understood that while one non-limiting example of the connector actuation tool 106 is depicted, alternative embodiments may include suitable variations, including but not limited to, a dog assembly at an upper portion of the connector actuation tool, any suitable number of actuation pistons at any suitable position of the connector actuation tool, any suitable motor arrangements, and the use of electric actuators instead of or in combination with hydraulic actuators.

In certain embodiments, the connector actuation tool 106 may be fitted with one or more sensors (not shown) to detect position, orientation, pressure, and/or other parameters of the connector actuation tool 106. For nonlimiting example, one or more sensors may detect the positions of the dog 116, the clamping tool 135, and/or splined member 150. Corresponding signals may be transferred to an information handling system at any suitable location on the vessel or platform by any suitable means, including wired or wireless means. In certain embodiments, control lines (not shown) for one or more of the motor 148, clamping tool 135, and dog assembly 114 may be feed back to the information handling system by any suitable means.

Figure 4:
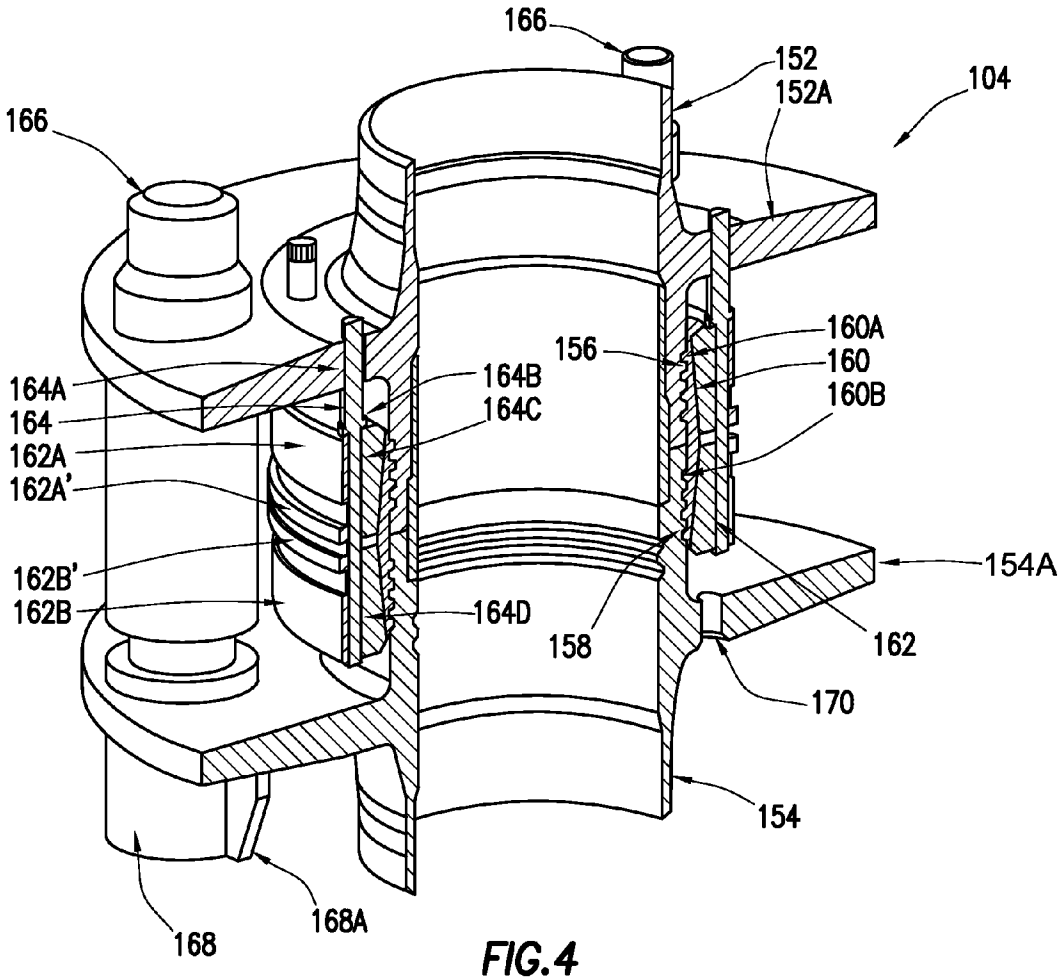
FIG. 4 shows a cross-sectional view of a connector assembly, in accordance with certain embodiments of the present disclosure.

FIG. 4 shows a cross-sectional view of a riser joint connector 104, in accordance with certain embodiments of the present disclosure. The riser joint connector 104 may include an upper tubular assembly 152 and a lower tubular assembly 154, each arranged in end-to-end relation. The upper tubular assembly 152 sometimes may be referenced as a box; the lower tubular assembly 154 may be referenced as a pin.

Certain embodiments may include a seal ring (not shown) between the tubular members 152, 154. The upper tubular assembly 152 may include grooves 156 about its lower end. The lower member 154 may include grooves 158 about its upper end. A lock ring 160 may be disposed about the grooves 156, 158 and may include teeth 160A, 160B. The teeth 160A, 160B may correspond to the grooves 156, 158. The lock ring 160 may be radially expandable and contractible between an unlocked position in which the teeth 160A, 160B are spaced from the grooves 156, 158, and a locking position in which the lock ring 160 has been forced inwardly so that teeth 160A, 160B engage with the grooves 156, 158 and thereby lock the connection. Thus, the lock ring 160 may be radially moveable between a normally expanded, unlocking position and a radially contracted locking position, which may have an interference fit. In certain embodiments, the lock ring 160 may be split about its circumference so as to normally expand outwardly to its unlocking position. In certain embodiments, the lock ring 160 may include segments joined to one another to cause it to normally assume a radially outward position, but be collapsible to contractible position.

A cam ring 162 may be disposed about the lock ring 160 and may include inner cam surfaces which are slidable over surfaces of the lock ring 160. The cam surfaces of the cam ring 162 may provide a means of forcing the lock ring 160 inward to a locked position. The cam ring 162 may include an upper member 162A and a lower member 162B with corresponding lugs 162A' and 162B'. The upper member 162A and the lower member 162B may be configured as opposing members. The cam ring 162 may be configured so that movement of the upper member 162A and the lower member 162B toward each other forces the lock ring 160 inward to a locked position via the inner cam surfaces of the cam ring 162.

The riser joint connector 104 may include one or more locking members 164. A given locking member 164 may be adapted to extend through a portion of the cam ring 162 to maintain the upper member 162A and the lower member 162B in a locking position where each has been moved toward the other to force the lock ring 160 inward to a locked position. The locking member 164 may include a splined portion 164A and may extend through a flange 152A of the upper tubular assembly 152. The locking member 164 may include a retaining portion 164B, which may include but not be limited to a lip, to abut the upper member 162A. The locking member 164 may include a tapered portion 164C to fit a portion of the upper member 162A. The locking member 164 may include a threaded portion 164D to threadedly engage the lower member 162B.

The riser joint connector 104 may include one or more auxiliary lines 166. For nonlimiting example, the auxiliary lines 166 may include one or more of hydraulic lines, choke lines, kill lines, and boost lines. The auxiliary lines 166 may extend through the flange 152A and a flange 154A of the lower tubular assembly 154. The auxiliary lines 166 may be adapted to mate between the flanges 152A, 154A, for example, by way of a stab fit.

The riser joint connector 104 may include one or more connector orientation guides 168. A given connector orientation guide 168 may be disposed about a lower portion of the riser joint connector 104. By way of example without limitation, the connector orientation guide 168 may be coupled to the flange 154A. The connector orientation guide 168 may include one or more tapered surfaces 168A formed to, at least in part, orient at least a portion of the riser joint connector 104 when interfacing one of the dog assemblies 114. When the dog assembly 114 contacts one or more of the tapered surfaces 168A of the connector orientation guide 168, the one or more tapered surfaces 168A may facilitate axial alignment and/or rotational orientation of the riser joint connector 104 by biasing the riser joint connector 104 toward a predetermined position with respect to the dog assembly 114. In certain embodiments, the connector orientation guide 168 may provide a first stage of an orientation process to orient the lower tubular assembly 154.

The riser joint connector 104 may include one or more orientation guides 170. In certain embodiments, the one or more orientation guides 170 may provide a second stage of an orientation process. A given orientation guide 170 may be disposed about a lower portion of the riser joint connector 104. By way of example without limitation, the orientation guide 170 may be formed in the flange 154A. The orientation guide 170 may include a recess, cavity or other surfaces adapted to mate with a corresponding guide pin 172 (depicted in FIG. 5).

Figure 5:
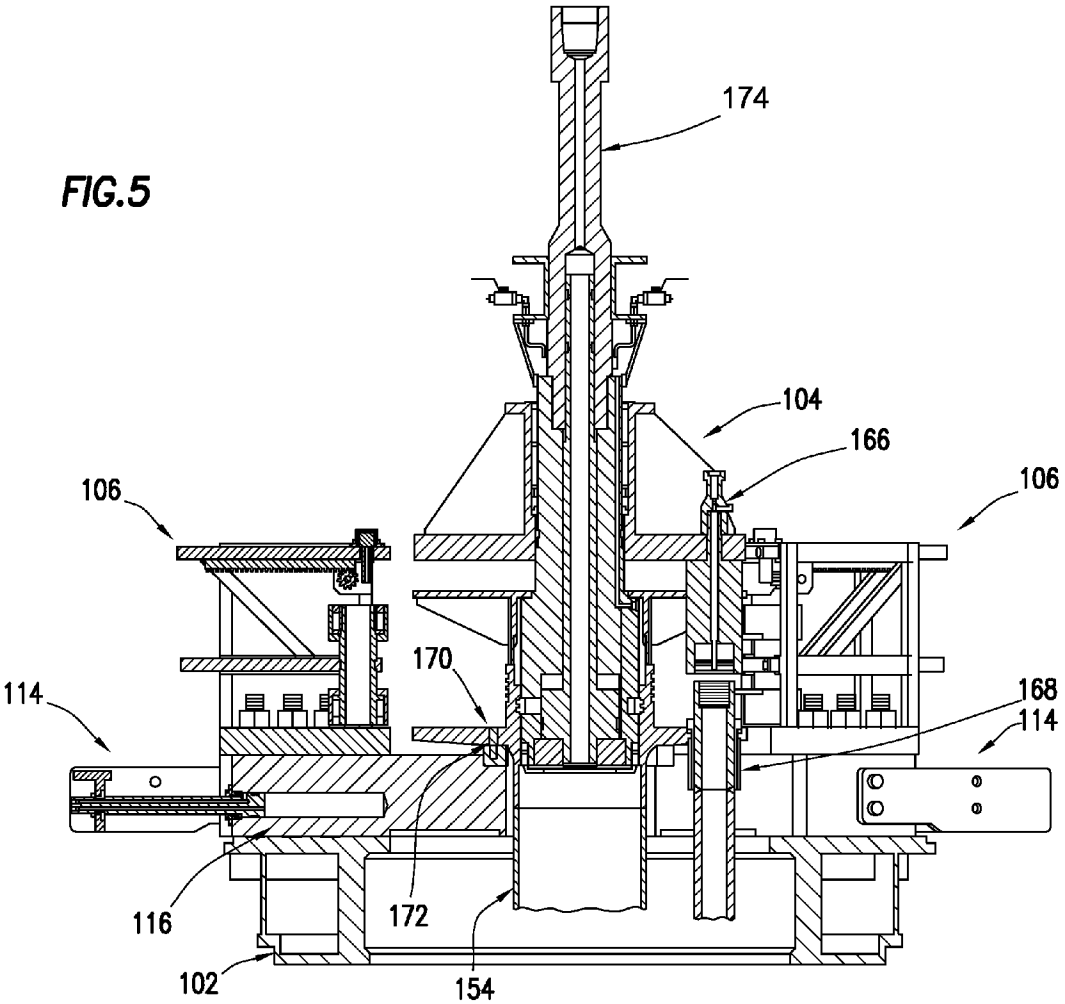
FIG. 5 shows a cross-sectional view of landing a riser section, which may include the lower tubular assembly, in the spider assembly, in accordance with certain embodiments of the present disclosure.

FIG. 5 shows a cross-sectional view of landing a riser section, which may include the lower tubular assembly 154, in the spider assembly 102, in accordance with certain embodiments of the present disclosure. In the example landed state shown, the dogs 116 have been extended to retain the tubular assembly 154, and the two-stage orientation features have oriented the lower tubular assembly 154. Specifically, the connector orientation guide 168 has already facilitated axial alignment and/or rotational orientation of the lower tubular assembly 154, and one or more of the dog assemblies 114 may include a guide pin 172 extending to mate with the orientation guide 170 to ensure a final desired orientation.

A running tool 174 may be adapted to engage, lift, and lower the lower tubular assembly 154 into the spider assembly 102. In certain embodiments, the running tool 174 may be adapted to also test the auxiliary lines 166. For example, the running tool 174 may pressure test choke and kill lines coupled below the lower tubular assembly 154.

In certain embodiments, one or more of the running tool 174, the tubular assembly 154, and auxiliary lines 166 may be fitted with one or more sensors (not shown) to detect position, orientation, pressure, and/or other parameters associated with said components. Corresponding signals may be transferred to an information handling system at any suitable location on the vessel or platform by any suitable means, including wired or wireless means.

Figure 6:
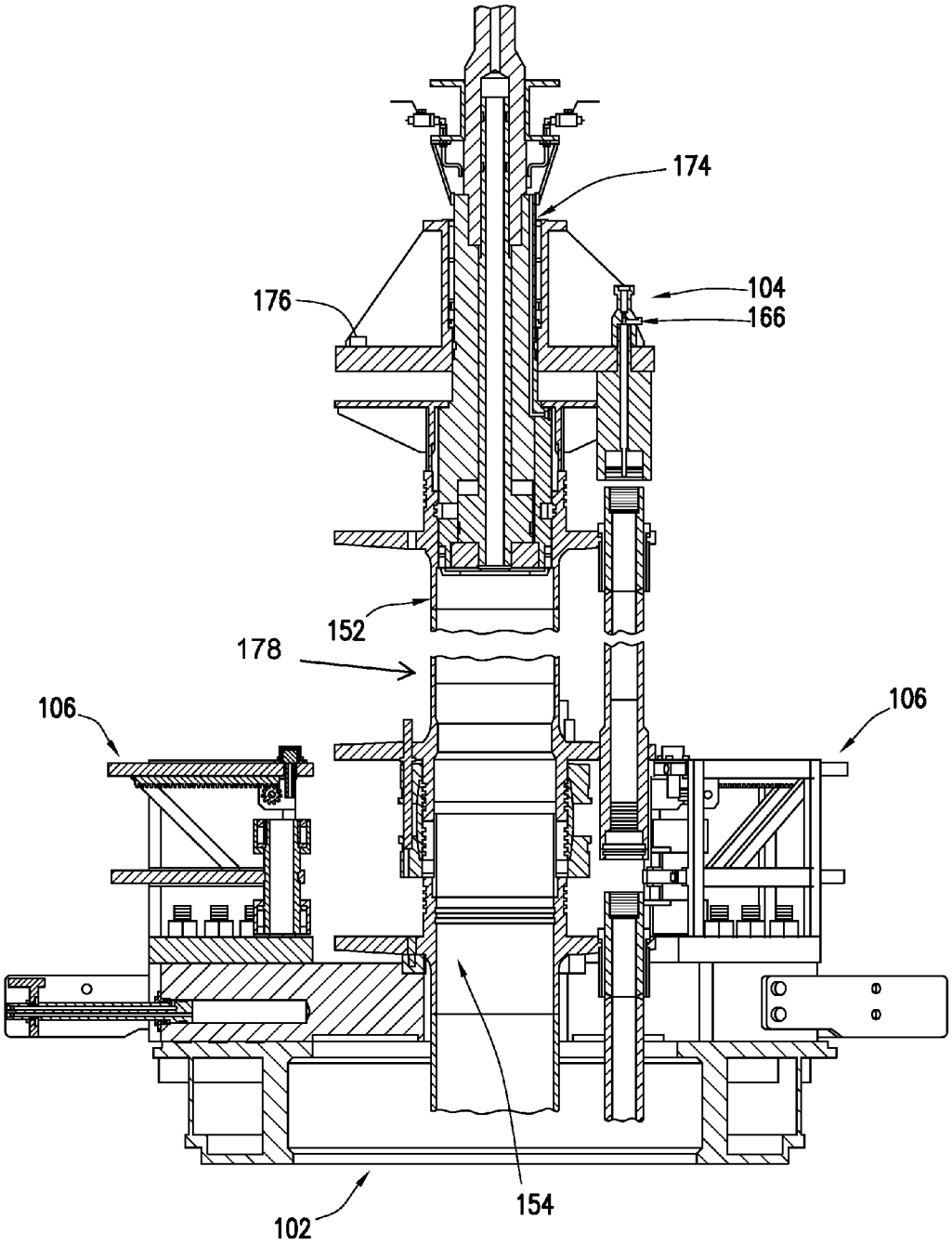
FIG. 6 shows a cross-sectional view of running the upper tubular assembly to the landed lower tubular assembly, in accordance with certain embodiments of the present disclosure.

FIG. 6 shows a cross-sectional view of running the upper tubular assembly 152 to the landed lower tubular assembly 154, in accordance with certain embodiments of the present disclosure. The running tool 174 may be used to engage, lift, and lower the upper tubular assembly 152. The upper tubular assembly 152 may be lowered onto a stab nose 178 of the lower tubular assembly 154.

In certain embodiments, the running tool 174 may include one or more sensors 176 to facilitate proper alignment and/or orientation of the upper tubular assembly 152. The one or more sensors 176 may be located at any suitable positions on the running tool 174. In certain embodiments, the tubular member 152 may be fitted with one or more sensors (not shown) to detect position, orientation, pressure, and/or other parameters of the tubular member 152. Corresponding signals may be transferred to an information handling system at any suitable location on the vessel or platform by any suitable means, including wired or wireless means.

Figure 7:
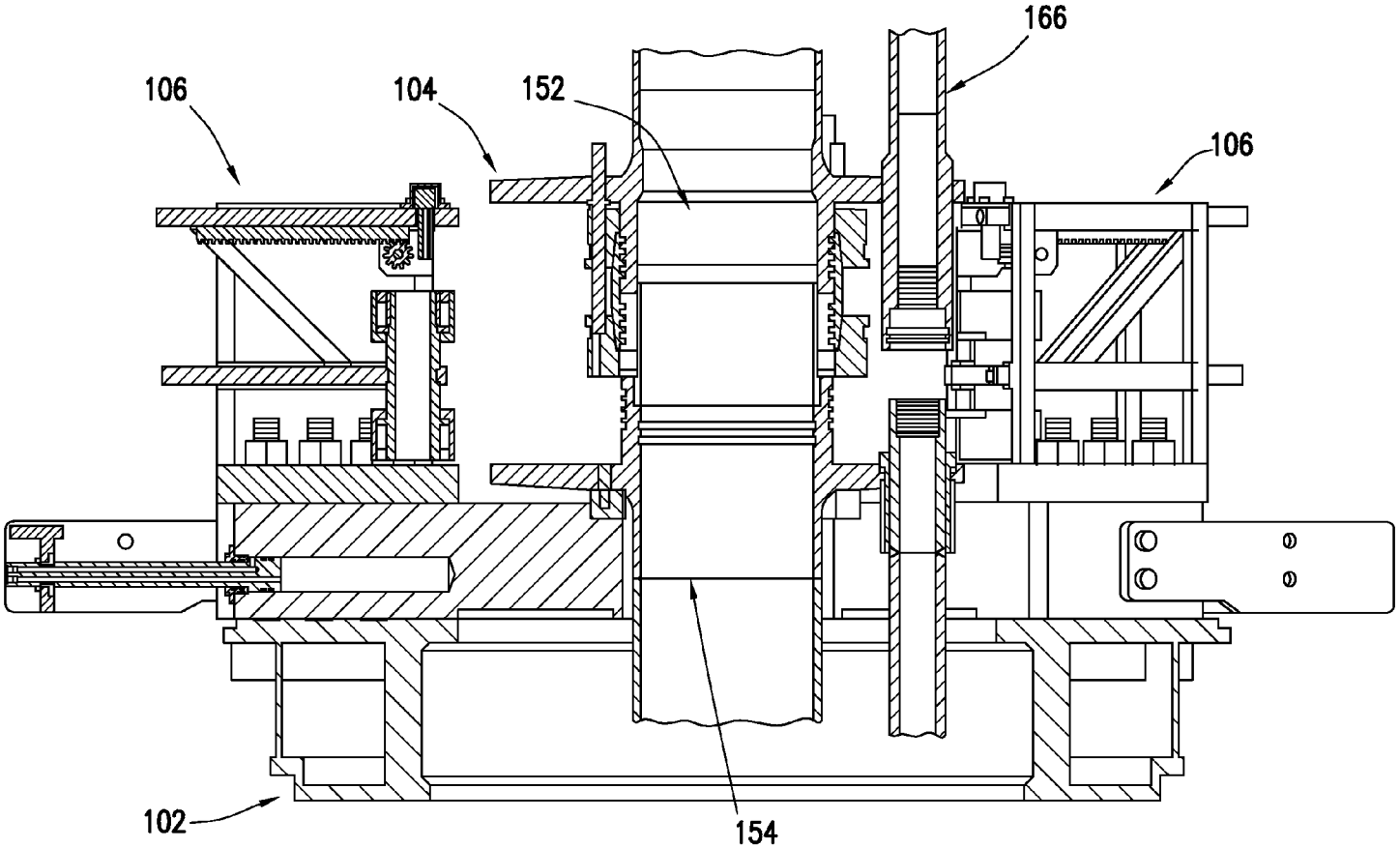
FIG. 7 shows a cross-sectional view of orienting an upper tubular assembly with respect to a lower tubular assembly, in accordance with certain embodiments of the present disclosure.

FIG. 7 shows a cross-sectional view of orienting the upper tubular assembly 152 with respect to lower tubular assembly 154, in accordance with certain embodiments of the present disclosure. It should be understood that orienting the upper tubular assembly 152 may be performed at any suitable stage of the lowering process, or throughout the lower process.

Figure 8:
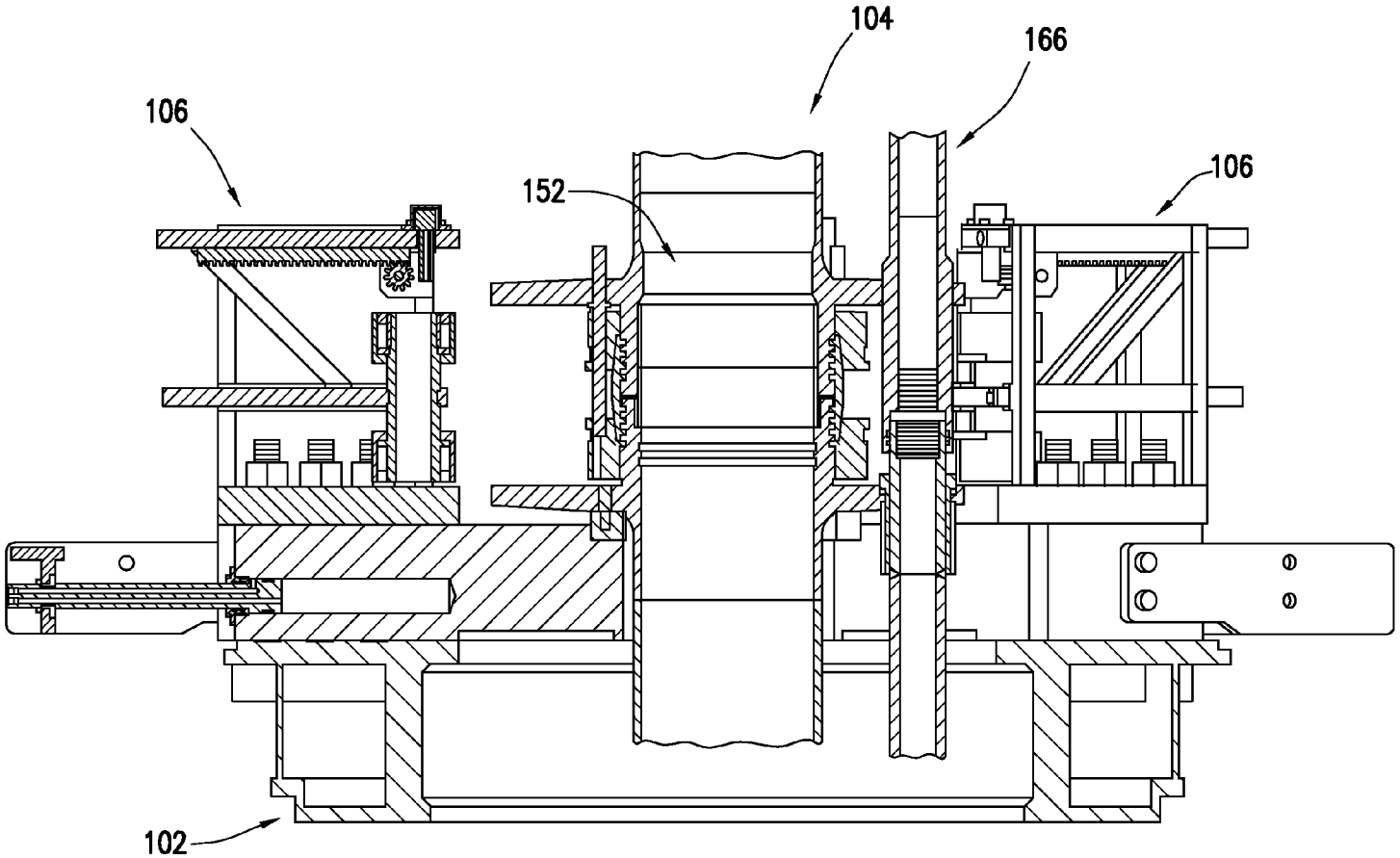
FIG. 8 shows a cross-sectional view of an upper tubular assembly landed, in accordance with certain embodiments of the present disclosure.

FIG. 8 shows a cross-sectional view of the upper tubular assembly 152 landed, in accordance with certain embodiments of the present disclosure.

Figure 9:
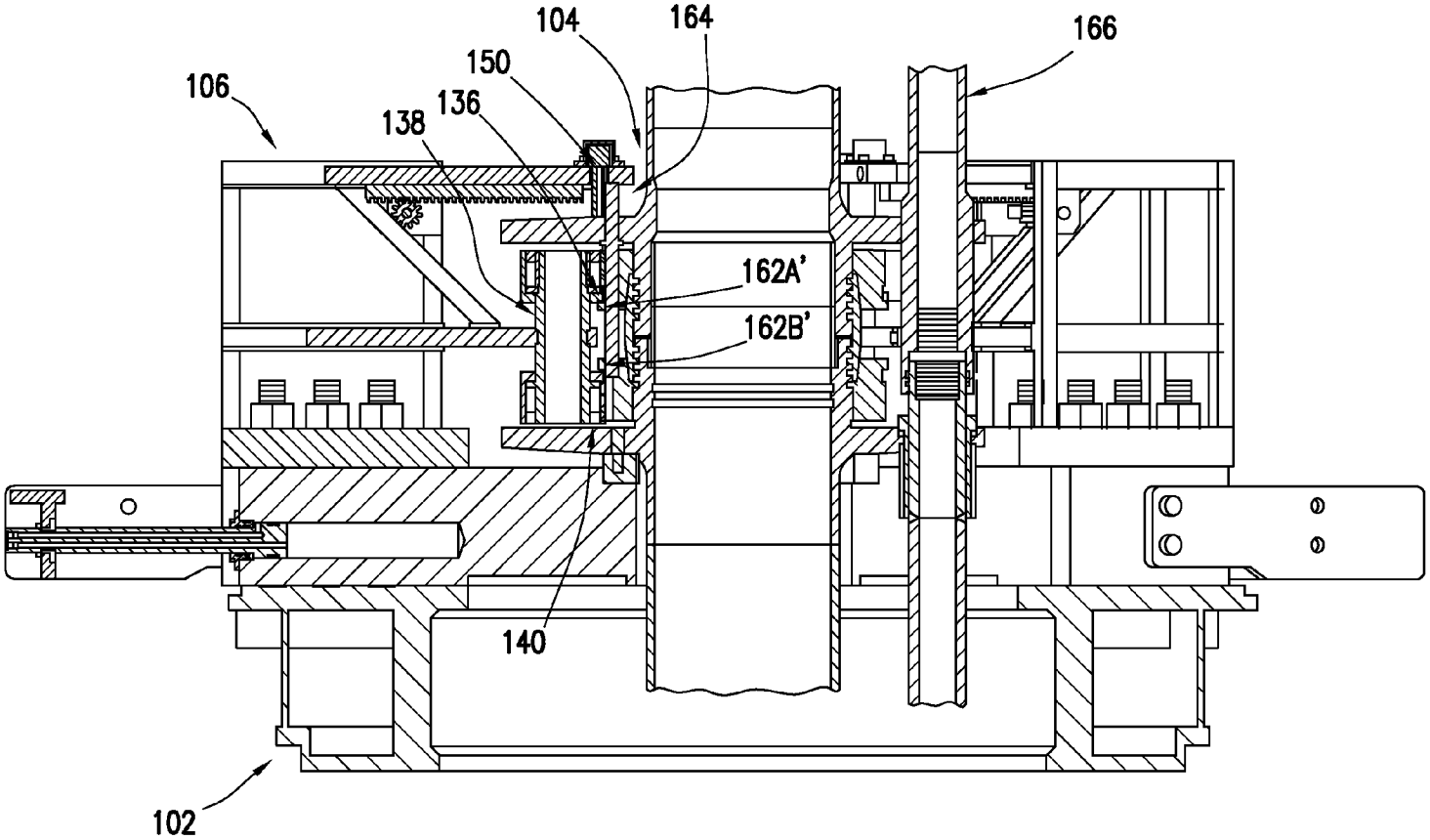
FIG. 9 shows a cross-sectional view of the connector actuation tool engaging a riser joint prior to locking a riser joint, in accordance with certain embodiments of the present disclosure.

FIG. 9 shows a cross-sectional view of the connector actuation tool 106 engaging the riser joint connector 104 prior to locking the riser joint connector 104, in accordance with certain embodiments of the present disclosure. As depicted, the actuation piston mandrel 138 may be extended toward the riser joint connector 104. The upper actuation piston 136 may engage the lug 162A' and/or an adjacent groove of the cam ring 162. Likewise, the lower actuation piston 140 may engage the lug 162B' and/or an adjacent groove of the cam ring 162. The splined member 150 may also be extended toward the riser joint connector 104. As depicted, the splined member 150 may engage the locking member 164. In various embodiments, the actuation piston mandrel 138 and the splined member 150 may be extended simultaneously or at different times.

Figure 10:
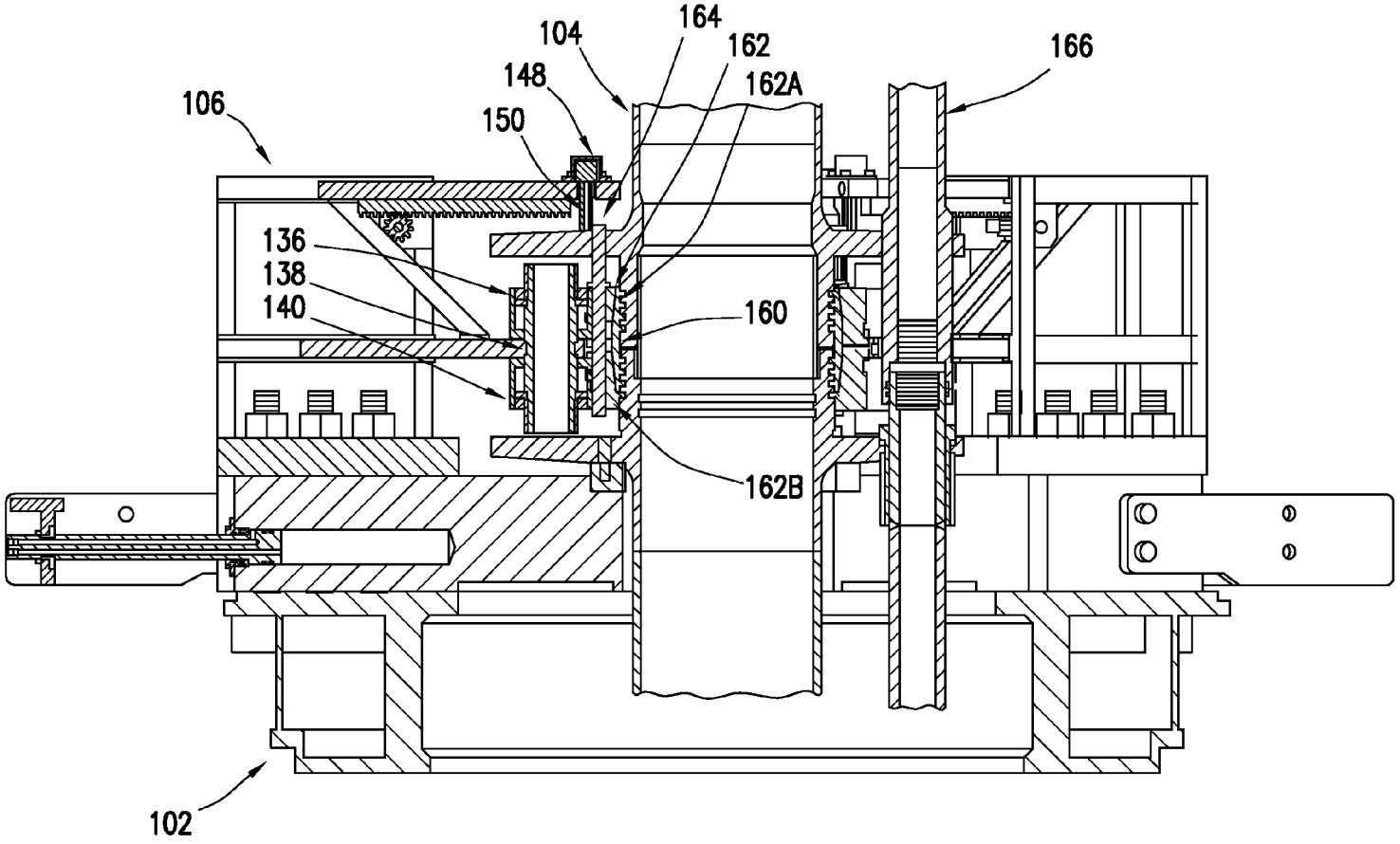
FIG. 10 shows a cross-sectional view of a connector actuation tool locking a riser joint, in accordance with certain embodiments of the present disclosure.

FIG. 10 shows a cross-sectional view of the connector actuation tool 106 locking the riser joint connector 104, in accordance with certain embodiments of the present disclosure. As depicted, with suitable hydraulic pressure having been applied to the upper and lower actuation pistons 136, 140, the upper and lower actuation pistons 136, 140 moved longitudinally along the actuation piston mandrel 138 toward a middle portion of the actuation piston mandrel 138. The upper member 162A and the lower member 162B of the cam ring 162 are thereby forced toward one another, which may act as a clamp that in turn forces the lock ring 160 inward to a locked position via the inner cam surfaces of the cam ring 162. As depicted, the locking member 164 may be in a locked position after the motor 148 has driven the splined member 150, which in turn has driven the locking member 164 into the locked position to lock the cam ring 162 in a clamped position. In various embodiments, the locking member 164 may be actuated into the locked position as the cam ring 162 transitions to a locked position or at a different time.

Figure 11:
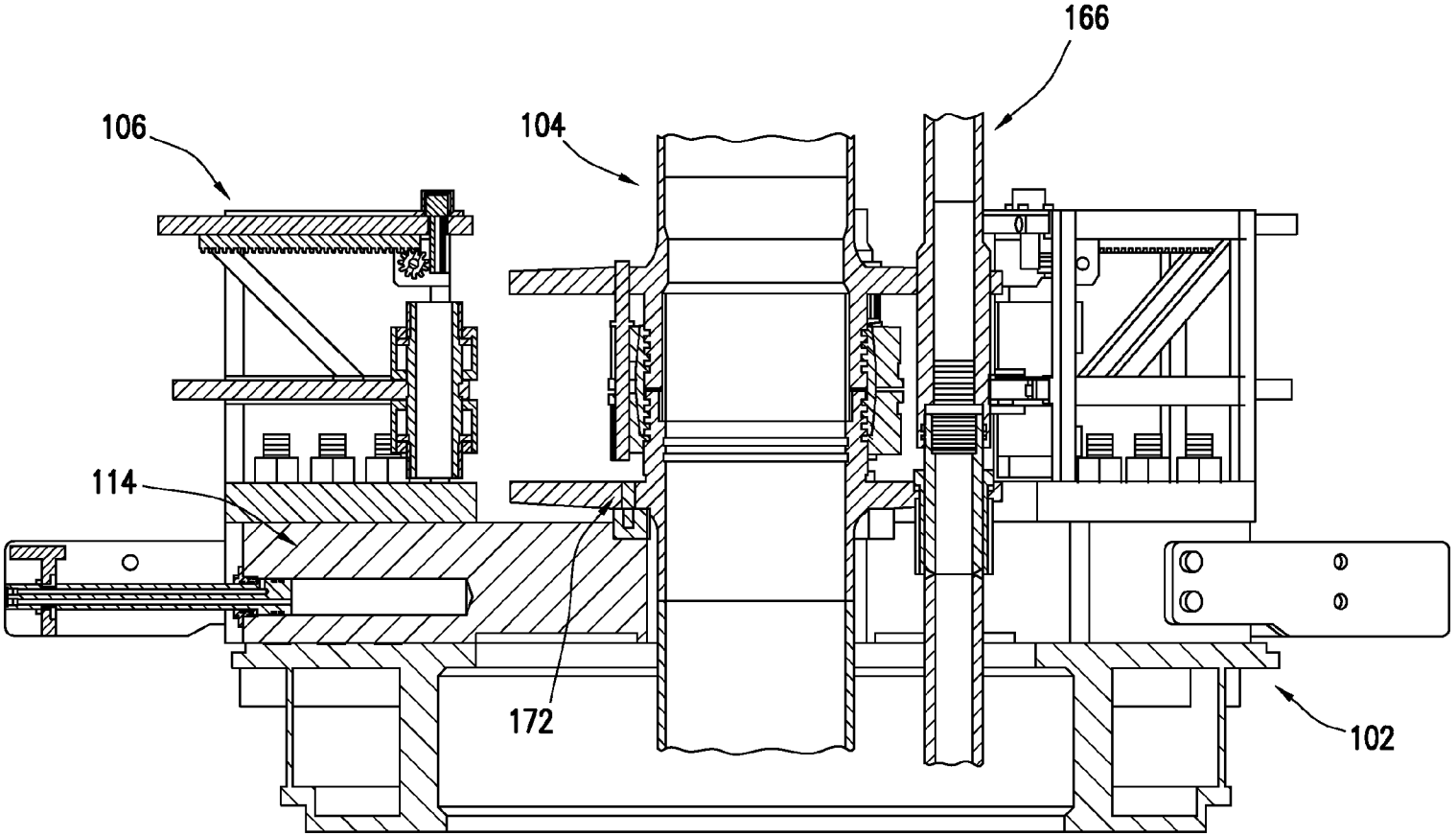
FIG. 11 shows a cross-sectional view of the connector actuation tool retracted, in accordance with certain embodiments of the present disclosure.

FIG. 11 shows a cross-sectional view of the connector actuation tool 106 retracted, in accordance with certain embodiments of the present disclosure. From that position, the running tool 174 (depicted in previous figures) may engage the riser joint connector 104 and lift the riser joint connector 104 away from the guide pin 172. The dogs 114 may be retracted, the riser joint connector 104 may be lowered passed the spider assembly 102, and the process of landing a next lower tubular may be repeated. It should be understood that a dismantling process may entail reverses the process described herein.

Accordingly, certain embodiments of the present disclosure allow for hands-free riser section coupling systems and methods. Certain embodiments allow for minimal and remote operator involvement. As a result, certain embodiments provide safety improvements in part by eliminating or significantly reducing direct operator involvement that would otherwise expose an operator to risks of injury, fatigue, and increased potential for human error. Moreover, certain embodiments allow for increased speed and efficiency in the riser section coupling process. Certain embodiments allow for lighter coupling components, for example, by eliminating or significantly reducing the need for heavy bolts and flanges. This may save material usage and augment the speed and efficiency of the riser section coupling process.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A riser coupling system, comprising:

a riser joint connector comprising:

a first tubular assembly;

a second tubular assembly;

a cam ring having an upper member and a lower member, wherein the upper member and the lower member are adjustable to retain the first tubular assembly and the second tubular assembly together;

a locking member adjustable to retain the cam ring in a locked position; and a lock ring, wherein movement of the upper member of the cam ring and the lower member of the cam ring toward each other locks the lock ring;

a running tool configured to move the first tubular assembly into orientation with the second tubular assembly; and a spider assembly to receive the riser joint connector, the spider assembly comprising a connector actuation tool, wherein the connector actuation tool comprises:

a dog assembly configured to selectively extend a dog to engage the riser joint connector;

a clamping tool to actuate the upper cam ring member and the lower cam ring member of the riser joint connector; and a splined member to actuate the locking member of the riser joint connector.

2. The riser coupling system of claim 1, wherein the spider assembly is remotely operated.

3. The riser coupling system of claim 1, wherein the dog assembly further comprises a piston assembly, wherein the piston assembly is operable to extend the dog to engage the riser joint connector.

4. The riser coupling system of claim 3, wherein the piston assembly is hydraulically driven.

5. The riser coupling system of claim 1, wherein the clamping tool comprises an upper actuation piston, an actuation piston mandrel and a lower actuation piston.

6. The riser coupling system of claim 1, wherein the splined member is extendable.

7. The riser coupling system of claim 1, further comprising a sensor, wherein the sensor detects position of at least one of the dog, the clamping tool and the splined member.

8. The riser coupling system of claim 1, wherein the connector actuation tool further comprises a motor and wherein at least one of the clamping tool and the splined member is driven by the motor.

9. A riser coupling system, comprising:

a riser joint connector comprising:

a first tubular assembly coupled to a second tubular assembly;

a cam ring having an upper member and a lower member, wherein the upper member and the lower member are adjustable to retain the first tubular assembly and the second tubular assembly together; and a lock ring, wherein movement of the upper member and the lower member toward each other locks the lock ring;

a spider assembly having a connector actuation tool, wherein the spider assembly receives the riser joint connector and wherein the connector actuation tool comprises:

a dog assembly, wherein the dog assembly selectively extends a dog to engage the riser joint connector;

a clamping tool, wherein the clamping tool couples the first tubular assembly and the second tubular assembly; and a splined member, wherein the splined member actuates a locking member of the riser joint connector.

10. The riser coupling system of claim 9, wherein the clamping tool actuates at least one of the upper member and the lower member of the cam ring.

11. The riser coupling system of claim 9, further comprising a running tool, wherein the running tool moves the first tubular assembly into orientation with the second tubular assembly.

12. The riser coupling system of claim 11, wherein at least one of the running tool and the spider assembly is remotely operated.

13. The riser coupling system of claim 9, wherein the dog assembly further comprises a piston assembly, wherein the piston assembly is operable to extend the dog to engage the riser joint connector.

14. The riser coupling system of claim 13, wherein the piston assembly is hydraulically driven.

15. The riser coupling system of claim 9, wherein the clamping tool comprises an upper actuation piston, an actuation piston mandrel and a lower actuation piston.

16. The riser coupling system of claim 9, wherein the splined member is extendable.

17. The riser coupling system of claim 9, further comprising a sensor, wherein the sensor detects position of at least one of the dog, the clamping tool and the splined member.

18. The riser coupling system of claim 9, wherein the connector actuation tool further comprises a motor and wherein at least one of the clamping tool and the splined member is driven by the motor.

* * * * *